United States Patent [19]

Heismann et al.

[11] 4,354,461

[45] Oct. 19, 1982

[54] TWO-CYCLE INTERNAL COMBUSTION ENGINE INCLUDING HORIZONTAL CRANKSHAFT

[75] Inventors: Richard A. Heismann, Knoxville; Richard L. Morris, Galesburg, both of Ill.

[73] Assignee: Outboard Marine Corporation, Waukegan, Ill.

[21] Appl. No.: 175,312

[22] Filed: Aug. 4, 1980

[51] Int. Cl.[3] ..... F02F 7/00; F02B 33/04

[52] U.S. Cl. ..... 123/195 AC; 123/73 A

[58] Field of Search ..... 123/392, 73 R, 73 A, 123/195 AC

[56] References Cited

U.S. PATENT DOCUMENTS

| | | | |
|---|---|---|---|
| Re. 27,367 | 5/1972 | Von Seggern et al. | 123/73 A |
| 1,780,635 | 11/1930 | Spencer | 123/73 A |
| 2,493,974 | 1/1950 | Jozif | 123/195 AC |
| 2,627,852 | 2/1953 | Dittmer | 123/195 AC |
| 2,682,259 | 6/1954 | Watkins | 123/73 A |
| 2,714,376 | 8/1955 | Bakke et al. | 123/195 AC |
| 2,717,586 | 9/1955 | Bakke et al. | 123/195 AC |
| 2,740,390 | 4/1956 | Irgens | 123/73 A |
| 2,759,716 | 8/1956 | Jones | 123/73 R |
| 3,109,416 | 11/1963 | Rose et al. | 123/195 AC X |
| 3,161,186 | 12/1964 | Reichenbach et al. | 123/392 |
| 3,170,449 | 2/1965 | Goggi | 123/73 A |
| 3,181,518 | 5/1965 | Kincannon | 123/73 R |
| 3,353,525 | 11/1967 | Nutten et al. | 123/73 R |
| 3,650,252 | 3/1972 | Glover et al. | 123/392 |
| 3,788,289 | 1/1972 | Pfister | 123/392 |

*Primary Examiner*—Wendell E. Burns

*Attorney, Agent, or Firm*—Michael, Best & Friedrich

[57] ABSTRACT

A two-cycle internal combustion engine includes a crankcase extending from a cylinder and supporting a horizontally extending crankshaft, a piston mounted for reciprocative movement in the cylinder along an axis generally perpendicular to the crankshaft axis, an air and/or fuel inlet on the crankcase including a flange disposed in a first plane extending generally parallel to the crankshaft axis and perpendicular to the piston axis and having a major axis extending transversely of the crankshaft axis, and a manifold having an outlet flange which is disposed in the first plane and has a major axis extending generally parallel to the major axis of the crankcase inlet flange and further having an inlet flange disposed in a second plane extending generally vertically and having a major axis which extends generally horizontally and is angularly related at a substantial angle to the major axis of the crankcase inlet flange. The engine further includes a float type carburetor having a vertically extending outlet flange which is connected to the manifold inlet flange and has a major axis, the carburetor float being operable to regulate fuel flow when the major axis of the carburetor flange is generally horizontal.

In one embodiment, a throttle member for controlling the flow of a fuel-air mixture from the carburetor into the crankcase is pivotally mounted inside the manifold and movement of the throttle member is controlled by an air vane governor mounted on the manifold.

8 Claims, 6 Drawing Figures

TWO-CYCLE INTERNAL COMBUSTION ENGINE INCLUDING HORIZONTAL CRANKSHAFT

BACKGROUND OF THE INVENTION

This invention relates to two-cycle internal combustion engines and, more particularly, to two-cycle internal combustion engines having a horizontal extending crankshaft and a float type carburetor.

A two-cycle internal combustion engine typically includes a crankshaft extending through a crankcase generally perpendicular to piston travel and an air and/or fuel inlet located in the crankcase opposite to the cylinder. When such an engine employs a float type carburetor and is oriented so that the crankshaft is vertical, the outlet flange of the carburetor air induction passage and the crankcase inlet flange are oriented such that the carburetor float is horizontal. For applications requiring such an engine to be oriented with the crankshaft horizontal, the orientation of the crankcase outlet flange is such that the carburetor would be inoperable because the float is in a non-horizontal position. Consequently, either a re-designed float type carburetor or a diaphram type carburetor is required.

SUMMARY OF THE INVENTION

The invention provides a two-cycle internal combustion engine including a crankcase supporting a crankshaft, means on the crankcase defining an air and/or fuel inlet, a carburetor including an induction passage and a float which is operable to regulate fuel flow into the induction passage, and means connecting the carburetor to the crankcase inlet such that, when the crankcase is located with the crankshaft extending generally horizontal, the carburetor is arranged with the float horizontal.

In one embodiment, the crankcase inlet includes a flange disposed in a first plane extending generally parallel to the crankshaft axis and generally perpendicular to the piston axis, and the connecting means includes a manifold having an interior passage, an outlet flange which is disposed in the first plane, which has a major axis extending generally parallel to the major axis of the crankcase inlet flange, and which is connected to the crankcase inlet flange. The manifold further includes an inlet flange which is disposed in a second plane extending generally vertically and has a major axis which extends generally horizontally and is angularly related at a substantial angle to the major axis of the crankcase inlet flange. The carburetor induction passage has an outlet flange which is disposed in the second plane, which has a major axis, and which is connected to the manifold inlet flange. The carburetor float is operable when the major axis of the carburetor outlet is generally horizontal. The angle between the major axes of the manifold inlet and outlet flanges usually is about 90°.

In one embodiment, the engine includes a throttle member for controlling fuel flow through the carburetor mounted in the interior passage of the manifold for pivotal movement between an open position and a fluid flow restricting position, a movable air vane connected to the throttle member for moving the throttle member in response to movement of the air vane, means for biasing the throttle member toward the open position, and means for impelling air against the air vane, in response to rotation of the engine, to move the air vane and urge the throttle member toward a fluid flow restricting position against the biasing force of the biasing means.

One of the principal features of the invention is the provision of a two-cycle internal combustion engine including a generally horizontal extending crankshaft and a float type carburetor.

Another of the principal features of the invention is the provision of such an engine including a manifold having an outlet which is disposed in a first plane extending generally parallel to the crankshaft and perpendicular to the piston axis and which is connected to a crankcase air and/or fuel inlet, and further having an inlet which is disposed in a second plane extending generally vertically and which has the outlet of the carburetor air induction passage secured thereto.

A further of the principal features of the invention is the provision of an internal combustion engine described in the preceding paragraph including a throttle member mounted inside the manifold for controlling flow from the carburetor to the crankcase and an air vane speed governor connected to the throttle member.

Other advantages and features of the invention will become apparent to those skilled in the art upon reviewing the following general description, the drawings, and the appended claims.

Figure 1:
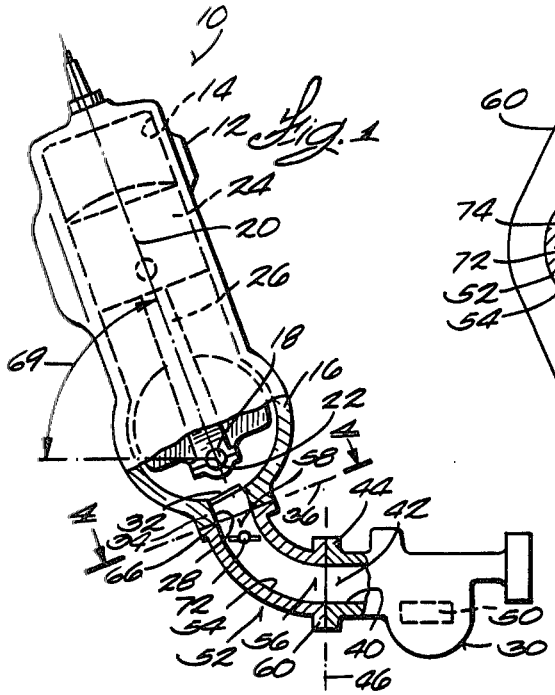
FIG. 1 is a sectional, partially diagramatic view of an internal combustion engine incorporating various of the features of the invention.

Before explaining at least one embodiment of the invention in detail, it is to be understood that the invention is not limiting in its application to the details of the construction and arrangement of parts set forth in the following general description or illustrated in the accompanying drawings, since the invention is capable of other embodiments and of being practiced or carried out in various ways. Also, it is to be understood that the phraseology or terminology employed herein is for the purpose of description and not of limitation.

GENERAL DESCRIPTION

Illustrated in the drawing is a two-cycle internal combustion engine 10 for a snow thrower or the like. The engine 10 includes an engine block 12 defining a cylinder 14 and a crankcase 16 extending from the cylinder 14 and rotatably supporting a horizontally crankshaft 18. Mounted for reciprocative movement inside the cylinder 14, along an axis 20 generally perpendicular to the crankshaft axis 22, is a piston 24 which is connected to the crankshaft 18 by a connecting rod 26.

Reciprocative movement of the piston 24 cyclically produces relatively high and low pressure conditions in the crankcase 16 in the usual manner with maximum and minimum crankcase pressures existing when the piston 24 is at bottom dead center and top dead center, respectively.

Figure 2:
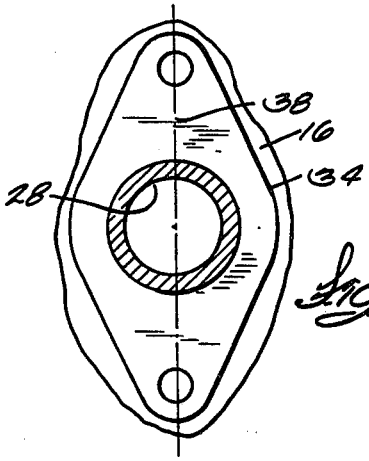
FIG. 2 is an enlarged view of the crankcase inlet flange of the engine shown in FIG. 1.

Located on the bottom portion of the crankcase 16 opposite the cylinder 14 is in inlet 28 through which a fuel-air mixture is introduced from a carburetor 30 in response to variations in the crankcase pressure. In the specific construction illustrated, the crankcase inlet 28 is covered by a reed valve 32 which opens to admit a flow of the fuel-air mixture when a low pressure condition exists in the crankcase 16 and which closed to prevent flow when a high pressure condition exists in the crankcase 16. The crankcase inlet 28 (FIGS. 1 and 2) includes a flange 34 disposed in a first plane 36 extending generally parallel to the crankshaft axis 22 and generally perpendicular to the piston axis 20. The crankcase inlet flange 34 has a major axis 38.

Figure 3:
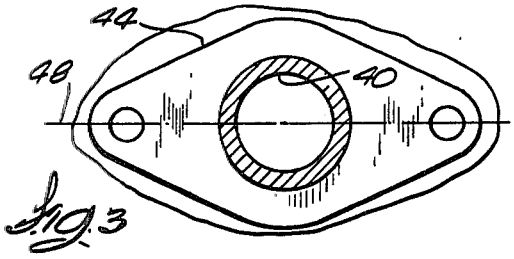
FIG. 3 is an enlarged view of the air induction passage outlet flange of the carburetor on the engine shown in FIG. 1.

The carburetor 30 is a conventional float type and has an air induction passage 40 including an outlet 42. The air induction passage outlet 42 includes a flange 44 disposed in a second plane 46 extending generally vertically (FIG. 1) and having a major axis 48 (FIG. 3). The carburetor 30 includes a fuel supply system which incorporates a float 50 (illustrated diagrammatically) and which is operable to regulate fuel flow into the air induction passage 40 in a usual manner when the air induction passage outlet flange 44 is disposed in the second plane 40 with the major axis 48 generally horizontally disposed.

Means are provided for connecting the carburetor 30 to the crankcase 16 such that, when the crankcase 16 is located with crankshaft 18 extending horizontally, the carburetor 30 is arranged with the float 50 horizontal.

In the specific construction indicated, such means includes a manifold 52 having an interior passage 54, an inlet 56, and an outlet 58. The manifold inlet 56 includes a flange 60 which is disposed in the second plane 46, which is suitably connected to the air induction passage outlet flange 44, and which has (FIG. 4) a major axis 64 extending parallel to the major axis 48 of the air induction passage outlet flange 44. The manifold outlet 58 includes a flange 66 which is disposed in the first plane 36, which is suitably connected to the crankcase inlet flange 30, and which has (FIG. 4) a major axis 68 extending parallel to the major axis 38 of the crankcase inlet flange 34. The major axis 64 of the manifold inlet flange 60 and the major axis 68 of the manifold outlet flange 66 are angularly related at a substantial angle. While other angular relationships can be used, this angle usually is about 90° as illustrated.

The manifold 52 can be arranged to accommodate different angular orientations of the cylinder 14 by varying the angular relationship of the plane of the outlet flange 66 to the plane of the inlet flange 60. The plane of the inlet flange 60 usually is generally vertical in order for the float 50 to be horizontal. For example, the above angular relationship can be varied from the outlet and inlet flanges 66 and 60 being generally parallel to each to the outlet flange 66 being at a 90° angle to the inlet flange 60. In the specific construction illustrated, the outlet flange 66 is at a 60° angle to the outlet flange 60. Since the inlet flange 60 is generally vertical and the outlet flange 66 is generally perpendicular to the piston axis 20, the piston axis 20 is about 60° from the horizontal as represented by the angle designated by reference numeral 69 in FIG. 1.

In the specific construction illustrated, flow of the fuel-air mixture through the carburetor 30 and into the crankcase 16 is controlled by (FIGS. 4 and 5) an air vane governor 70 mounted on the manifold 52. The air vane governor 70 includes a generally circular throttle member or plate 72 disposed in the interior passage 54 of the manifold 52 near the manifold outlet 58. The throttle plate 72 is pivotal between an open position extending generally parallel to the direction of flow and a fluid flow restricting position extending generally transversely of the direction of flow.

Figure 4:
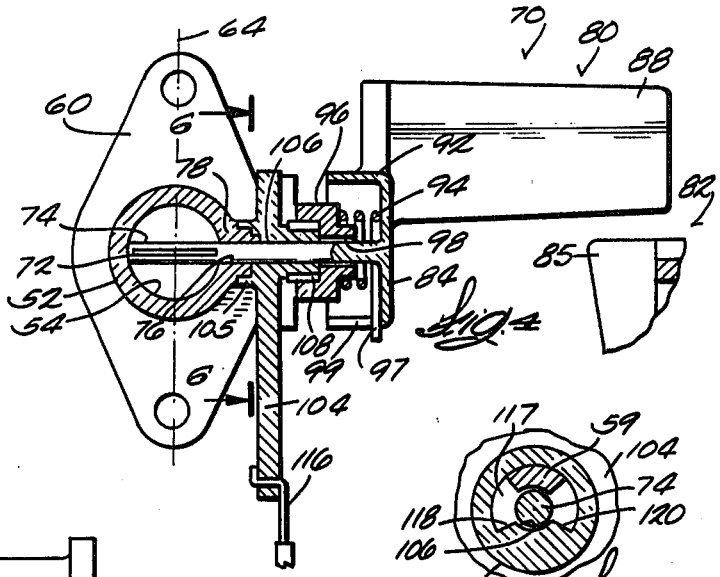
FIG. 4 is an enlarged sectional view taken generally along line 4—4 in FIG. 1 showing an air vane governor for controlling engine speed.
Figure 5:
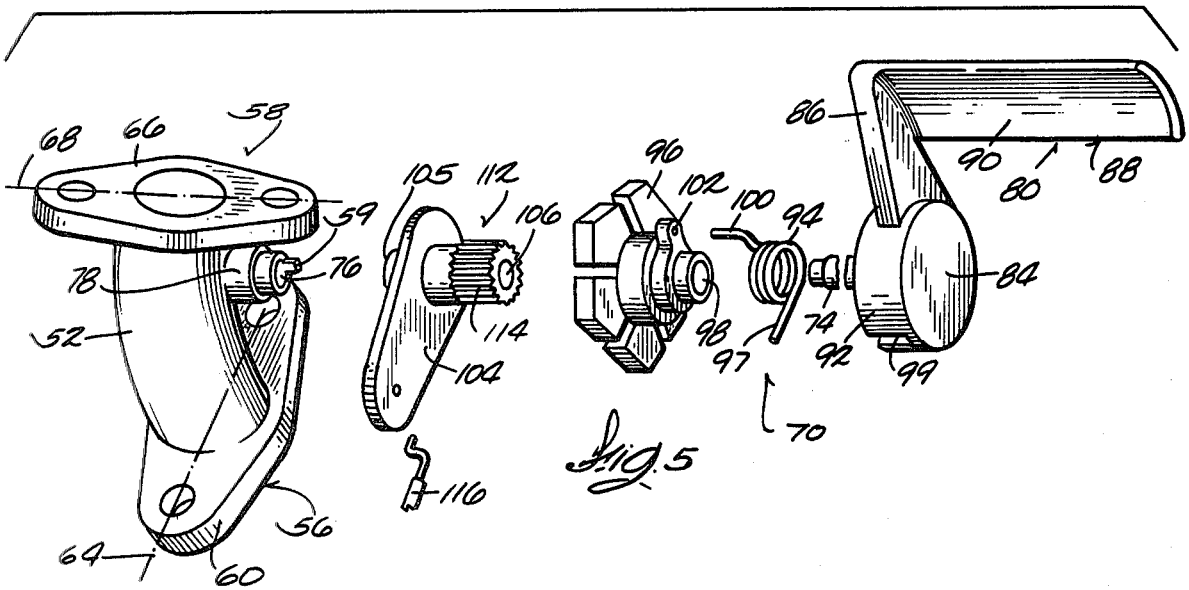
FIG. 5 is an exploded perspective view of the air vane governor and the manifold connecting the carburetor to the crankcase.

The throttle plate 72 is carried on the inner end of a rotatable shaft 74 which extends through a central bore 76 of a cylindrical boss 78 on the manifold 52. Located on the outer end of the manifold boss 58 is an arcuate stop 59, the purpose of which is described below. Connected to the outer end of the shaft 74 for controlling the position of the throttle plate 72 during engine operation is an air vane 80 which is located in close proximity to the engine flywheel 82 (FIG. 4). The engine flywheel 82 includes a plurality of radially extending, circumferentially spaced fins or impeller blades 85 (one shown) which impel or blow air against the air vane 80. The force applied on the air vane 80 by this air flow is related to the operational speed of the engine flywheel 82 and, thus, to engine speed.

More specifically, the air vane 80 includes a generally circular body 84 fixedly connected to the outer end of the shaft 74 and an arm 86 which extends radially from the body 84. The arm 86 includes an axially extending, generally rectangular, curved blade 88 which has a concave surface 90 facing the periphery of the engine flywheel 82. The blade 88 is located so that the air impelled against the concave surface 90 by the impeller blades 85 creates a torque on the shaft 74 urging the throttle plate 72 toward a flow restricting position. This torque increases with an increase in engine speed and decreases with a decrease in engine speed. The air vane 80 also includes an annular wall 92 extending axially from the body 84 toward the manifold 52.

The torque applied on the shaft 74 by the air vane 80 is balanced by a torsion spring 94 encircling the shaft 74 and having one end acting on the shaft 74 to bias the throttle member 72 toward the open position. Thus, as the force of the air flow impelled against the blade 88 increases with increased engine speed, the torque applied on the shaft 74 by the air vane 80 overcomes the biasing force of the spring 94 and pivots the throttle plate 72 toward a flow restricting position to reduce the engine speed.

In the event engine speed decreaes due to an increased load, the rotational speed of the engine flywheel 82 decreases. As the force of the air impelled against the blade 88 decreases due to reduced engine speed, the closing torque applied on the shaft 74 by the air vane 80 decreases and the spring 94 tends to urge the throttle member or plate 72 toward an open position to permit an increased flow of the fuel-air mixture through the manifold 52 with a resultant increase in engine speed. Thus, the combined affect of the air vane 80, the finned engine flywheel 82, and the spring 94 tends to cause the engine to operate at a preselected speed, irrespective of the load on the engine. This preselected engine speed is governed primarily by the rotational tension or biasing force of the spring 94 on the throttle plate 72.

Adjustment means are provided for adjusting the biasing force of the spring 94 on the throttle plate 72. In the specific construction illustrated, such means includes an adjustment collar 96 having a central bore 98 through which the shaft 74 extends. One end 97 of the spring 94 is anchored in a slot 99 in the annular wall 92 of the air vane 80 and the other end 100 is anchored in an aperture 102 in the adjustment collar 96. The adjustment collar 96 is mounted for common rotation with a throttle control lever 104 which has a hub 105 pivotally received on the manifold boss 78 and which has a central bore 106 through which the shaft 74 extends. The central bore 98 of the adjustment collar 96 includes a plurality of mating elements which can be in the form of internal splines 108.

The throttle control lever 104 (FIG. 4) includes an outwardly projecting boss 112 having a plurality of mating elements which can be in the form of external splines 114 adapted to mate with the internal splines 108 in the adjustment collar 96. Rotation of the adjustment collar 96 relative to the throttle control lever boss 112 adjusts the tension on the spring 94 and, thus, the torque on the shaft 74 biasing the throttle plate toward the open position. To adjust spring tension, the adjustment collar 96 is moved axially outwardly (i.e., to the right) from the position illustrated in FIG. 4 to a position wherein the adjustment collar splines 108 are disengaged from the throttle control lever splines 114.

Figure 6:
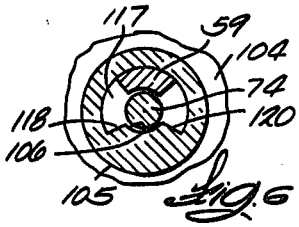
FIG. 6 is a fragmentary sectional view taken generally along line 6—6 in FIG. 4.

Referring to FIG. 6, the throttle plate hub 105 has an arcuate, internal guideway 117 rotatably receiving the stop 59 on the manifold boss 58 and including shoulders 118 and 120 which engage the stop 59 to limit rotational movement of the throttle lever 104, in one direction during adjustment of tension on the spring 94 and in the opposite direction when the throttle lever 104 is rotated for making a speed adjustment during engine operation as described below. In FIG. 6, the throttle lever 104 is shown in an intermediate position relative to the stop 59, prior to tensioning the spring 94, for the sake of clarifying illustration.

The maximum engine operating speed preferably is set at the factory. This is accomplished by rotating the adjustment collar 96 with the splines 108 disengaged from the throttle control lever splines 114 until the desired tension is applied on the spring 94. The adjustment collar 96 is then pushed onto the throttle control lever boss 112 to mate the adjustment collar splines 108 with the throttle control lever splines 114.

During engine operation, the throttle plate 72 is maintained in the open position by the spring 94 until the engine speed reaches a point where the torque applied on the shaft 74 by the air vane 80 exceeds the biasing force of the spring 94. When this occurs, the throttle plate 72 is moved toward a flow restricting position, causing a reduction in engine speed until the forces applied on the shaft 74 by the air vane 80 and the spring 94 are balanced. In the event the engine speed decreases because of an increased load, the resulting reduction in rotational speed of the engine flywheel 82 causes a corresponding reduction in the torque applied on the shaft 74 by the air vane 80 to a point where the spring 94 overcomes that torque and urges the throttle plate 72 toward the open position. Thus, the air vane 80 and the spring 94 tend to maintain the engine at a relatively constant speed even under different load conditions.

When desired, the operator can effect additional engine speed control by moving the throttle lever 104, either directly or remotely via conventional bowden cable 116 connected to the throttle control lever 104. This moves the adjustment collar 96 and causes an adjustment in the tension of the spring 94 with a resultant change in the engine speed.

Various of the features of the invention are set forth in the following claims:

We claim:

1. A two-cycle, internal combustion engine comprising a cylinder, a crankcase extending from said cylinder and supporting a generally horizontally extending crank shaft having an axis, a piston connected to said crankshaft and mounted for reciprocative movement in said cylinder along an axis extending generally perpendicularly to the crankshaft axis at an angle to the horizontal, means on said crankcase defining an air and/or fuel inlet including a flange disposed in a first plane extending generally parallel to the crankshaft axis and generally perpendicularly to the piston axis, a manifold having an interior passage, an outlet flange which is disposed in said first plane and which is connected to said crankcase inlet flange, and an inlet flange disposed in a second plane which extends generally vertically and which is angularly related to said first plane at said angle, and a carburetor including an air induction passage having an outlet flange which is disposed in said second plane and which is connected to said manifold inlet flange, said carburetor including a float and being operable to regulate fuel flow into said air induction passage when said second plane is vertical.

2. An internal combustion engine according to claim 1 wherein said crankshaft inlet flange has a major axis extending transversely of the crankshaft axis, and wherein said carburetor outlet flange has a major axis.

3. An internal combustion engine according to claim 2 wherein the angle between the major axis of said crankcase inlet flange and the major axis of said carburetor outlet flange is about 90°.

4. An internal combustion engine according to claim 1 including a throttle member for controlling the fluid flow through said carburetor, said member being disposed in said manifold and pivotable between an open position and a fluid flow restricting position, a movable air vane connected to said throttle member for moving said throttle member in response to movement of said air vane, means for biasing said throttle member toward the open position, and means for impelling air against said air vane, in response to engine rotation, to move said air vane and urge said throttle member toward a fluid flow restricting position against a biasing force of said biasing means.

5. An internal combustion engine according to claim 4 including a rotatable shaft carrying said throttle member and fixedly connected to said air vane, wherein said biasing means comprises a torsion spring encircling said shaft, having a first end, and having a second end connected to said air vane, and wherein said engine further includes adjustment means connected to said first end of said spring for adjusting the biasing force of said spring on said throttle member.

6. An internal combustion engine according to claim 5 wherein said adjustment means comprises a collar surrounding said shaft and connected to said first end of said spring and means for locking said collar in an adjusted position.

7. An internal combustion engine according to claim 6 including a throttle control lever mounted for pivotal movement relative to said manifold and relative to said shaft and wherein said locking means comprises means on said adjustment collar and on said throttle control lever for mating said adjustment collar with said throttle control lever for common pivotal movement.

8. An internal combustion engine according to claim 7 wherein said mating means comprises mating splines on said throttle control lever and said adjustment collar.

* * * * *